United States Patent [19]

Fee

[11] Patent Number: 4,832,261

[45] Date of Patent: May 23, 1989

[54] RAILWAY RAIL FASTENING ASSEMBLY

[75] Inventor: Graham M. Fee, Geneva, Ohio

[73] Assignee: Chemetron-Railway Products, Inc., Wheeling, Ill.

[21] Appl. No.: 12,408

[22] Filed: Feb. 9, 1987

[51] Int. Cl.[4] ..... E01B 9/28

[52] U.S. Cl. ..... 238/331; 238/351

[58] Field of Search ..... 238/310, 315, 338, 349, 238/351, 354, 331, 333, 343, 361, 364

[56] References Cited

U.S. PATENT DOCUMENTS

| | | | |
|---|---|---|---|
| 1,422,340 | 7/1922 | Cooper et al. | 238/349 |
| 1,863,145 | 6/1932 | Young | 238/349 X |
| 1,925,717 | 9/1933 | Faries et al. | 238/349 X |
| 1,995,020 | 3/1935 | Woodings | 238/338 X |
| 2,215,104 | 9/1940 | Kimmel | 238/349 |
| 2,257,077 | 9/1941 | Scholes | 238/349 |
| 2,385,032 | 9/1945 | Scholes | 238/349 |
| 2,547,839 | 4/1951 | Schulze | 238/349 |
| 2,570,871 | 10/1951 | Schulze | 238/351 X |
| 3,164,323 | 1/1965 | Steele et al. | 238/349 |
| 3,494,558 | 2/1970 | Brown | 238/349 |
| 4,109,860 | 8/1978 | Serafin et al. | 238/349 |
| 4,254,909 | 3/1981 | Rex | 238/340 |
| 4,349,151 | 9/1982 | Schumaker | 238/349 |
| 4,373,667 | 2/1983 | Duchemin | 238/349 |
| 4,513,912 | 4/1985 | Shumaker | 238/349 |
| 4,600,145 | 7/1986 | Geddes | 238/351 |

*Primary Examiner*—Johnny D. Cherry
*Assistant Examiner*—Joseph D. Pape
*Attorney, Agent, or Firm*—Welsh & Katz, Ltd.

[57] ABSTRACT

A compact, low profile, boltless, two piece railway rail fastening assembly for securing a railway to a conventional tie plate having spike holes enabling the tie plate to be affixed to a wooden cross tie. The assembly includes a drive-on, generally platelike, rail engaging, resilient, metal fastening clip coacting with a shoulder having a pair of anchor legs adapted for insertion through a pair of spike holes proximate the rail base flange so as to anchor the shoulder to the tie plate. The shoulder and rail clip cooperate to provide a positive interlocking relation which retains the clip against the rail base flange and secures the rail against movement under load.

31 Claims, 9 Drawing Sheets

RAILWAY RAIL FASTENING ASSEMBLY

BACKGROUND OF THE INVENTION

The present invention relates to a fastening assembly for securing a railway rail to a support therefor and, more particularly, relates to a compact, low profile, boltless, two piece, drive-on, railway rail fastening assembly designed for use with a standard tie plate anchored to a wooden cross tie. The objective is to provide a low cost, durable rail fastening system which will fit existing tie plates used on wood ties and allow rail installation and removal without pulling spikes from the tie.

The installation of new railway rail, the removal of installed rail, or the transposition of worn rail from side to side, when conventional tie spikes and tie plates are used on wooden cross ties, present a major undertaking and pose a problem for railroads, particularly in zones of track curvature where rail wear is accelerated. To install a new rail or to interchange rails on an existing track bed, requiring the pulling and redriving of tie spikes, would cause spike loosening and thereby reduce the ability of the spikes to function in holding a rail in place and in preventing rail overturn.

There are a variety of railway rail fastening assemblies available in the market place today for use with wooden cross ties. However, known devices employ either bolt fasteners of some type requiring maintenance to tighten the bolts, which may become loosened during assembly use, without which could lead to clip dislocation, or a shoulder configured for placement in a single spike hole on a conventional tie plate. Additionally, many of the existing assemblies present a high profile subject to snagging or damage from equipment dragging from passing trains or other vehicles. Other systems also require use of associated rail anchors to provide sufficient force to restrain a rail against longitudinal movement.

The present inventive assembly, utilizing existing tie plate spike holes, functions to help overcome or lessen the aforementioned difficulties of rail installation and removal by providing a means for anchoring a rail to a tie plate while additionally providing a means for easy system disassembly allowing for rail removal without removal of tie spikes. Additionally, the present device eliminates bolt maintenance, provides a clip locking feature to maintain the clip in the intended installed position, allows for sufficient longitudinal rail restraint to eliminate the need for rail anchors, resists rail overturn especially on curves, utilizes both tie plate spike holes adjacent the rail and has a low profile to minimize damage resulting from dragging train equipment or a derailment.

SUMMARY OF THE INVENTION

The present invention relates to a boltless two piece fastening assembly for use in securing a railway rail supported on a conventional tie plate affixed to a wooden cross tie wherein a retaining shoulder is adapted for positioning relatively close to the base flange of the rail and cooperatively receives a platelike resilient spring clip adapted to be driven towards the rail into latching engagement therewith for securing the rail to the tie plate. The shoulder is designed to be anchored in the tie plate spike holes located proximate the base flange of the rail to be secured. The shoulder includes depending legs which can either be affixed to the tie plate directly or project therethrough. The downwardly, through projecting legs include a jaw for engaging the tie plate and terminate in a hook-like structure used for engaging the underside of the tie plate. The clip is provided with a detent adapted for coaction with a cooperating portion of the shoulder, for resisting removal of the clip after it has been forced into assembled relationship with the retaining shoulder. The clip might further include a projecting portion adapted to abut the shoulder to prevent the clip from being driven beyond its operative position and it might additionally include a sloped face at its rail bearing end to assist in guiding the clip along the base of the rail during clip installation. In another embodiment, the clip might include a downwardly projecting portion which can be manipulated to disengage the clip and the shoulder should disassembly be desired. In all embodiments, the clip can be disassembled from its associated shoulder by driving the clip away from the rail while forcing the shoulder towards the rail.

The various objects, features and advantages of the present invention, together with the organization and manner of operation thereof, will become apparent from the following detailed description of the invention when taken in conjunction with the accompanying drawings wherein like reference numerals designate like elements throughout the several views.

The various features of novelty which characterize the invention are pointed out with particularity in the claims annexed to and forming a part hereof.

BRIEF DESCRIPTION OF THE DRAWINGS

FIG. 9A is a side elevational view of a shoulder adapted to open toward the rail.

DETAILED DESCRIPTION OF THE PREFERRED EMBODIMENTS

Figure 1:
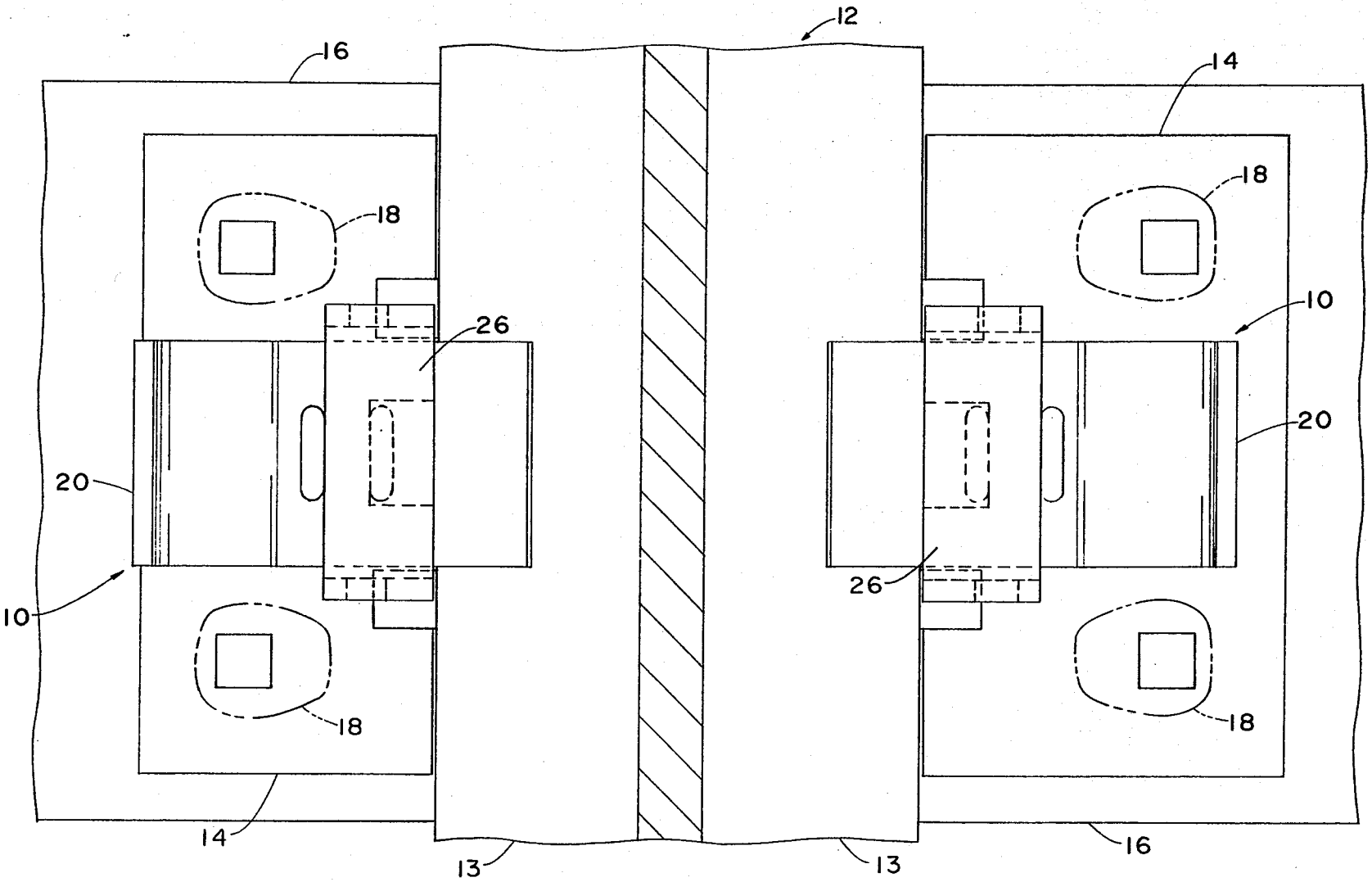
FIG. 1 is a fragmentary plan view illustrating a pair of rail fastening assemblies, in accordance with the principles of the present invention, acting in concert to secure a railway rail on a conventional tie plate which is attached to a wooden cross tie.
Figure 2:
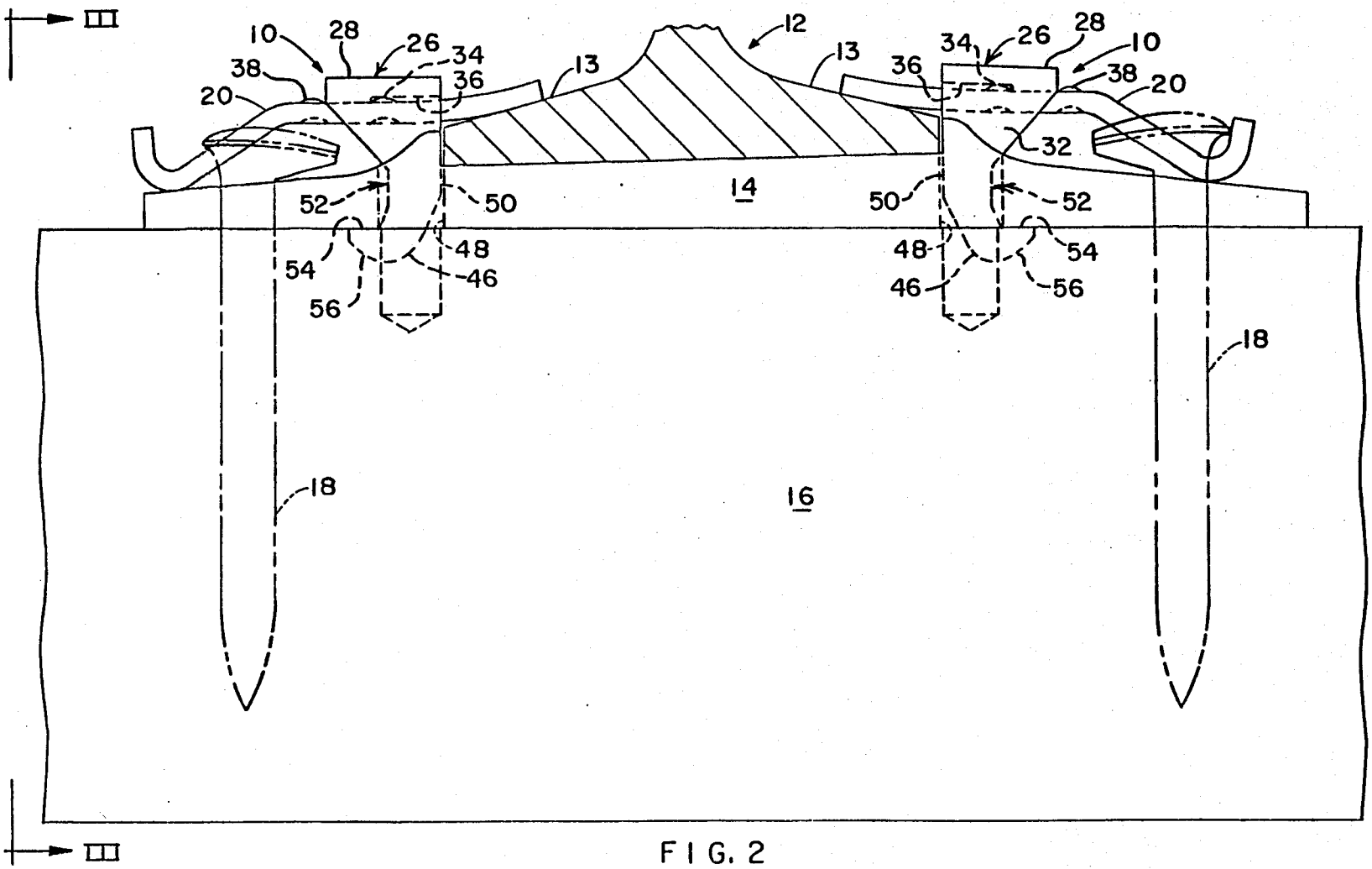
FIG. 2 is a front elevational view of the rail fastening assemblies shown in FIG. 1.
Figure 3:
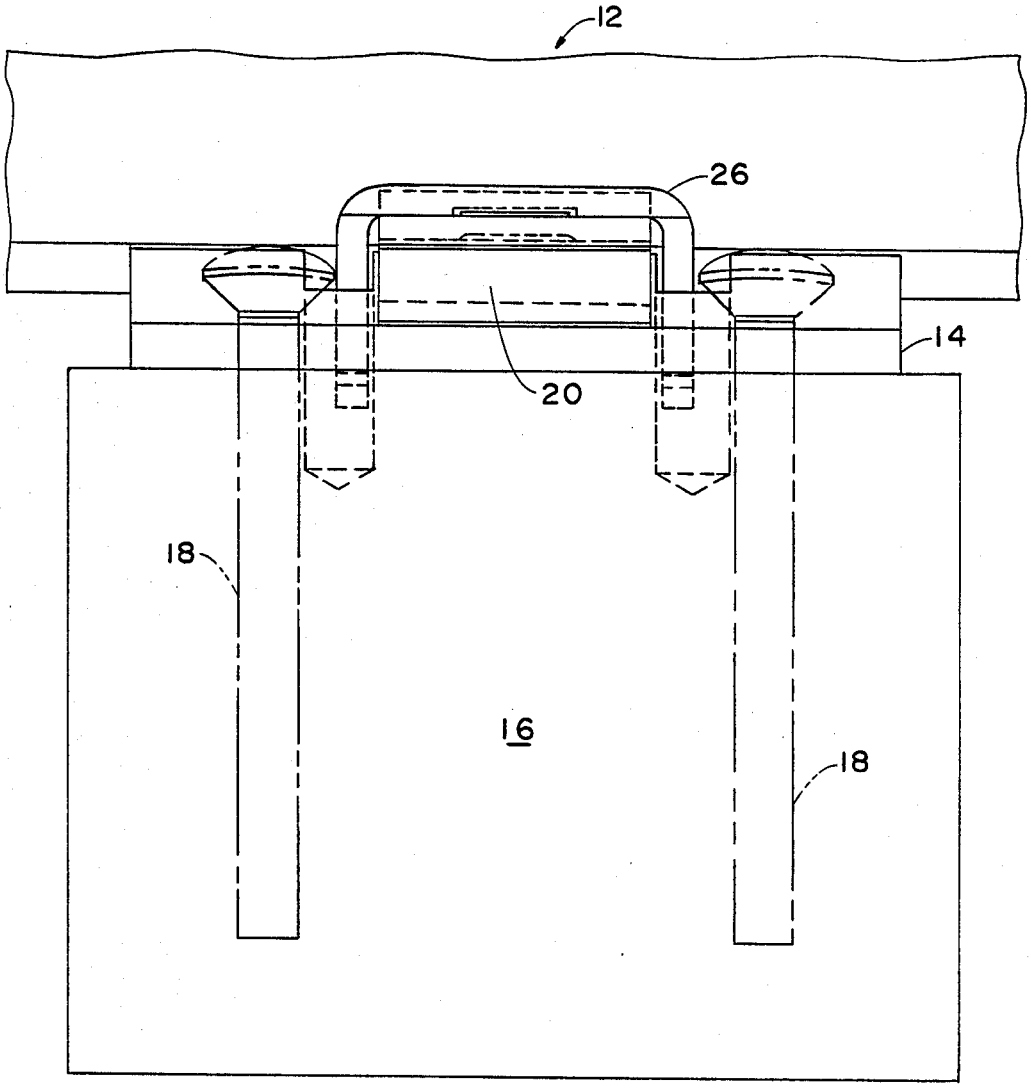
FIG. 3 is a side elevational view taken substantially along line III—III of FIG. 2 and illustrating the leftmost assembly depicted in FIG. 2.
Figure 4:
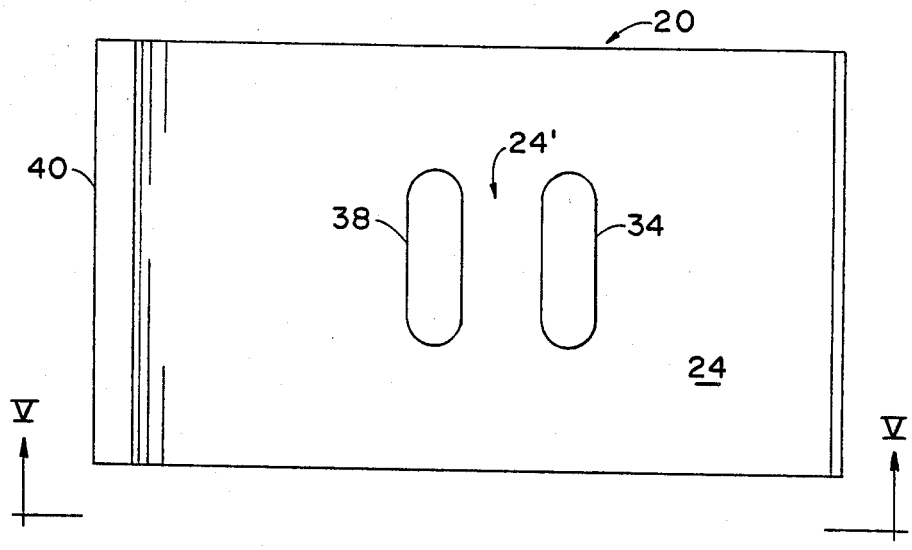
FIG. 4 is a plan view of one of the rail clips shown in the assemblies of FIG. 1.
Figure 5:
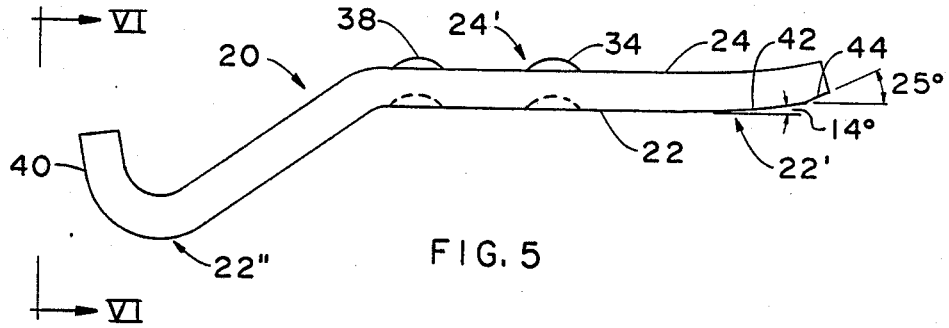
FIG. 5 is a front elevational view of the clip depicted in FIG. 4.
Figure 6:
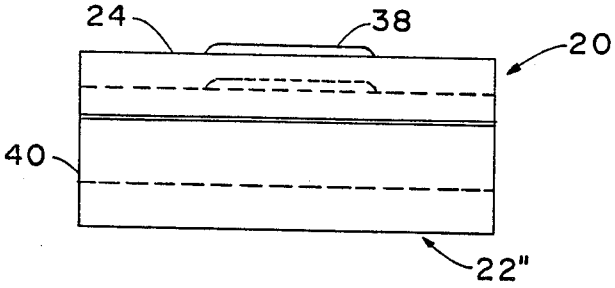
FIG. 6 is a left side elevational view of the clip of FIG. 5.
Figure 7:
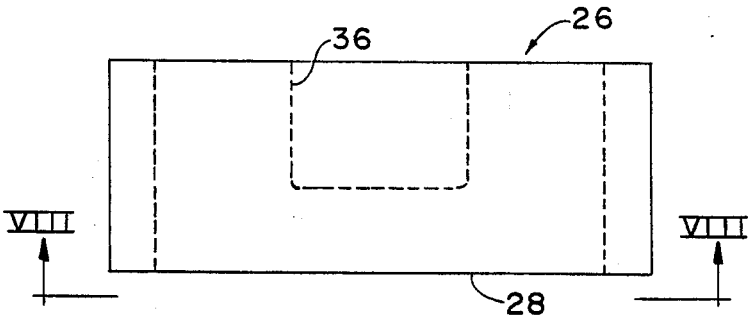
FIG. 7 is a plan view of one of the retaining shoulders used in the assemblies of FIG. 1.
Figure 8:
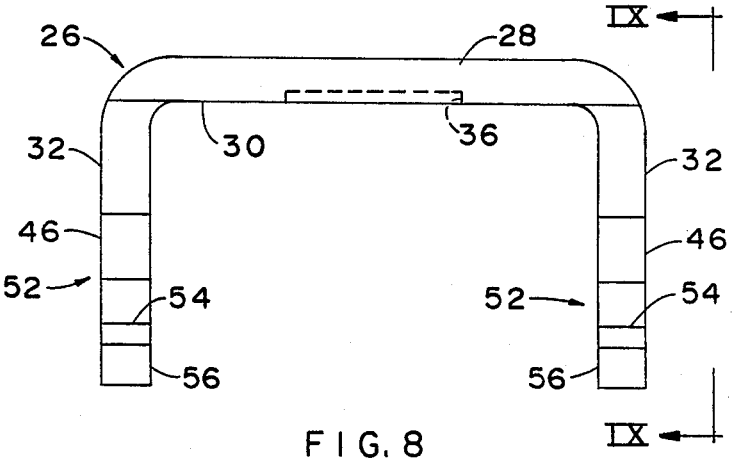
FIG. 8 is a front elevational view of the shoulder depicted in FIG. 7.

The description herein presented refers to the accompanying drawings in which like reference numerals refer to like parts throughout the several views, and in which, referring to FIGS. 1 and 2, there is illustrated a pair of installed railway rail fastening assemblies 10 of the present invention. The rail fastening assemblies are being used to secure against movement of a railway rail 12, partially shown, supported on a conventional tie plate 14 which is attached to a wooden cross tie 16 by spikes 18. FIG. 3 provides a side elevational view of one of the assemblies 10 depicted in FIGS. 1 and 2. Railway rail fastening assembly 10 includes, as illustrated in FIGS. 3 through 9, a resilient, drive-on, platelike, metal, spring clip 20, having a first bearing surface 22 and a second bearing surface 24, and a restraining shoulder 26 including head portion 28, having a generally flat clip engaging bottom surface 30, and a base portion 32. The first clip bearing surface 22 includes a rail bearing end and a tie plate bearing end designated generally at locations 22' and 22", respectively. The second clip bearing surface 24 includes a shoulder bearing portion designated generally at location 24'.

Clip 20, on second bearing surface 24, may include an upwardly projecting portion or boss 34. The shoulder head portion 28 may include a recess 36 formed in the clip engaging surface 30 for receiving boss 34 in latching engagement therewith when the shoulder and clip are operatively engaged. Clip 20, on second bearing surface 24, may additionally include an upraised portion or boss 38 which abuts shoulder head portion 28 to prevent the clip from being driven beyond its operative position during clip installation. Clip 20, at the tie plate engaging end 22", might include an upturned distal end 40 to provide a surface for driving the clip into operative engagement with shoulder 26, as can best be seen in FIG. 5. The clip, at the rail engaging end 22', might include a ramp surface 42 having an upwardly sloping surface of about 14° and terminating in a lip 44 which has an upwardly sloping surface of about 25° to aid in guiding the clip along rail base 13 of rail 12 during assembly installation.

Figure 9:
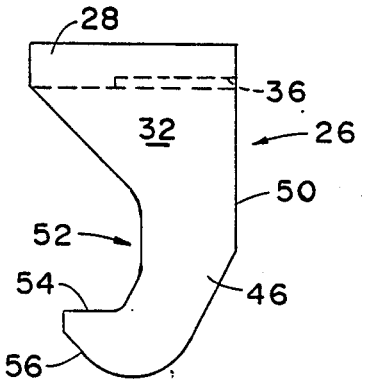
FIG. 9 is a right side elevational view of the shoulder of FIG. 8.

Shoulder base portion 32 includes downwardly depending members or legs 46 which may be positioned in apertures 48 located in tie plate 14 adjacent railway rail 12 as illustrated in FIG. 2. Each of the legs 46 has generally flat tie plate aperture bearing surface 50, a jaw 52 with a tie plate engaging portion 54, and terminates in a hook-like portion or segment 56. The hook-like segments 56 passes beneath the bottom surface of the tie plate to secure the shoulder to the tie plate. The jaw 56 may open in a direction facing away from the rail, as illustrated in FIGS. 2 and 9, or may be configured to open in a direction facing toward the rail, as illustrated in FIG. 9A wherein reference numerals designating structural features similar to the embodiment of FIG. 9 include the suffix "a". Instead of passing through apertures 48, legs 46 without hook-like portion 56 (not shown) may be positioned in the apertures and welded or otherwise affixed thereto.

The rail clip 20 and the shoulder 26 may be manufactured from fine grain carbon or alloy steel, formed into a desired configuration, as depicted in the drawings, and heat treated to a Rockwell harndess on the C scale of between approximately 40 to approximately 44. The shoulder is designed to fit standard A.R.E.A. tie plates. The clip is of one size and is adapted to fit all cooperating shoulders while the shoulders may vary in size depending upon the size of the tie plate, aperture spacing and position installed. The shoulder may be placed into tie plate apertures located on either the field or gage side of a track. The combined assembly of shoulder and clip, fully installed, has a low profile with an overall height of approximately 1.12 inches as measured from the top of the tie. Additionally, the assembly weighs approximately 1.70 pounds.

Assembly installation is accomplished by placing the shoulder legs into the tie plate side holes adjacent the rail to be secured. The clip is then hammered under the shoulder and onto the base of the rail, the front or toe portion of the clip riding up the slope of the rail base flange. The top of the shoulder extends away from the rail and engages an embossed portion of the clip to provide a self-tightening locking feature which assures that the clip remains correctly installed under train loads by keeping the clip from backing out after installation but which facilitates clip installation. As the clip is driven into operative position, the shoulder tends to tilt towards the rail which relieves pressure on the clip embossing. If the clip tends to back out, the shoulder is pulled away from the rail and increases locking pressure on the clip embossing. As lateral forces act on a fully installed clip, the shoulder has an outward tilting motion, away from the rail, which "forbids" the embossing on the clip to project out from under the shoulder, thus locking it in place. The clip is fully installed when the shoulder locks between bosses on the clip, the trailing boss functioning to stop clip advancement when it is driven to the proper installed position. The clip may be released from its operative holding position by forcing the shoulder towards the rail while forcing the clip to move in a direction away from the rail. Thus an assembly may be disengaged without pulling any tie plate securing spikes and, after removal of sufficient assemblies, allow for rail removal without spike removal. Furthermore, the clip can be re-applied with a minimum loss of rail restraining capability.

In a preferred embodiment, the assembly includes a two-legged, hook-in shoulder which utilizes both spike holes in a tie plate. Use of dual spike holes allows for distribution of static and dynamic train loads evenly across a larger area of the tie plate providing greater strength and stability than is customary when employing a conventional assembly using only one spike hole in the tie plate wherein there is developed a high concentration of stresses within a smaller loading area. Additionally, the present two-legged, hook-in shoulder and rail clip firmly secures the rail to the tie plate thus eliminating any pivot point wherein longitudinal forces may act to cause fastener skewing as might be encountered with assemblies using a single leg shoulder. Furthermore, in the present assembly, with the rail clip wedged under the shoulder and on the top of the rail base, under rail overturn conditions, the rail clip comes up against the shoulder, restricting deflection, and, therefore, preventing rail overturn.

The assembly disclosed herein has been subjected to a variety of tests, namely, toe load, longitudinal restrain and fatigue. In the toe load test, the fastening assembly was determined to have a toe load greater than 2600 pounds. The test method consisted of applying a lateral load to the head of the rail until the rail base deflected 0.025 inches. In the longitudinal restraint test, an applied load of 5400 pounds was required to cause a rail to move one inch. The assembly meets A.R.E.A. specifications which require a loading of 2400 pounds held for 15 minutes with maximum slip of 0.200 inches after the initial 3 minutes and a maximum slip of 0.010 inches for the remaining 12 minutes. In the fatigue test, the assembled system met a 3 million cycle fatigue test without any failure to any components. Testing consisted of loading the system at a rate of 200 cycles per minute at a 20 degree angle with a 30,000 pound downward force and a 1000 pound upward force.

Figure 10:
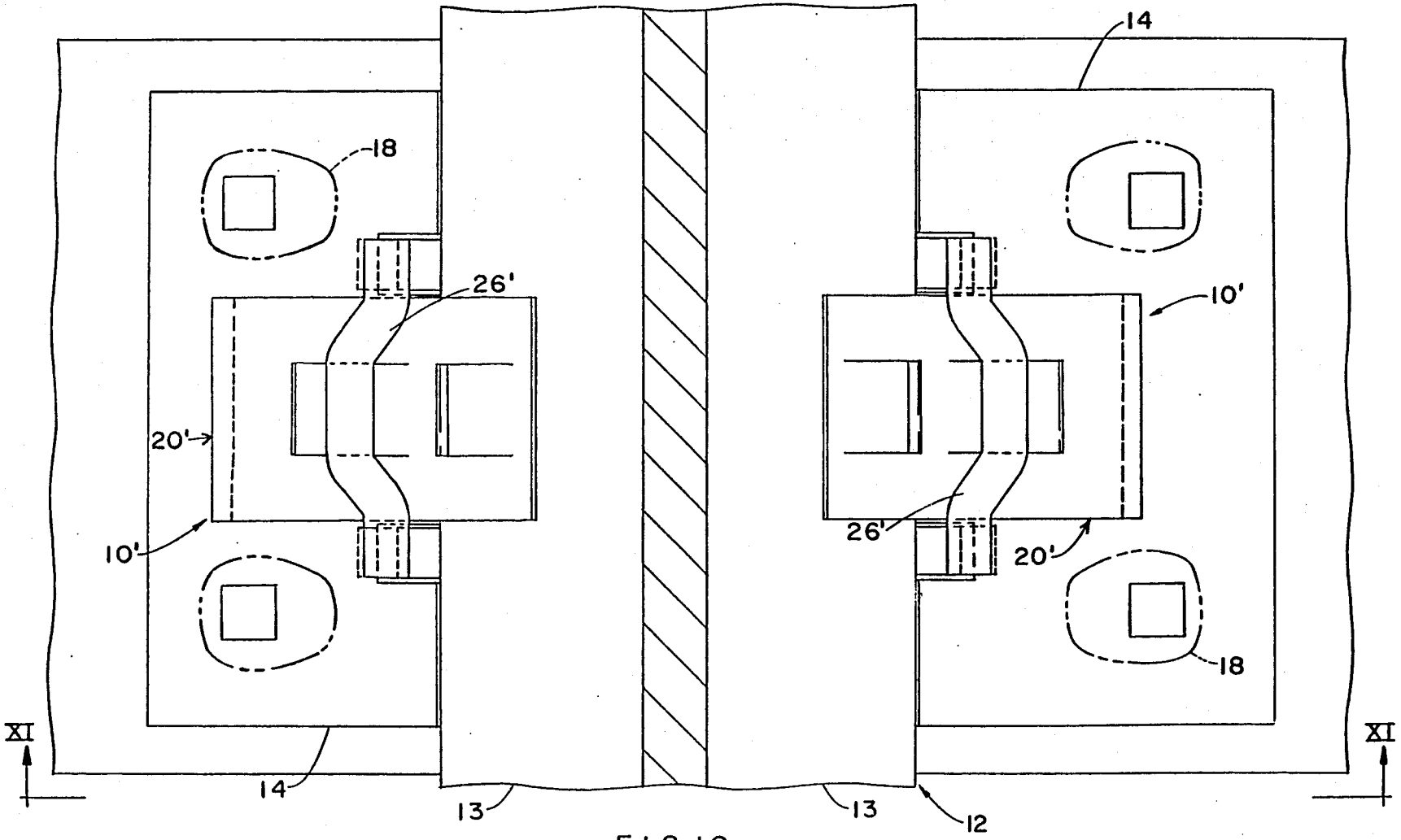
FIG. 10 is a fragmentary plan view similar to FIG. 1 but illustrating another embodiment of a rail fastening assembly.
Figure 11:
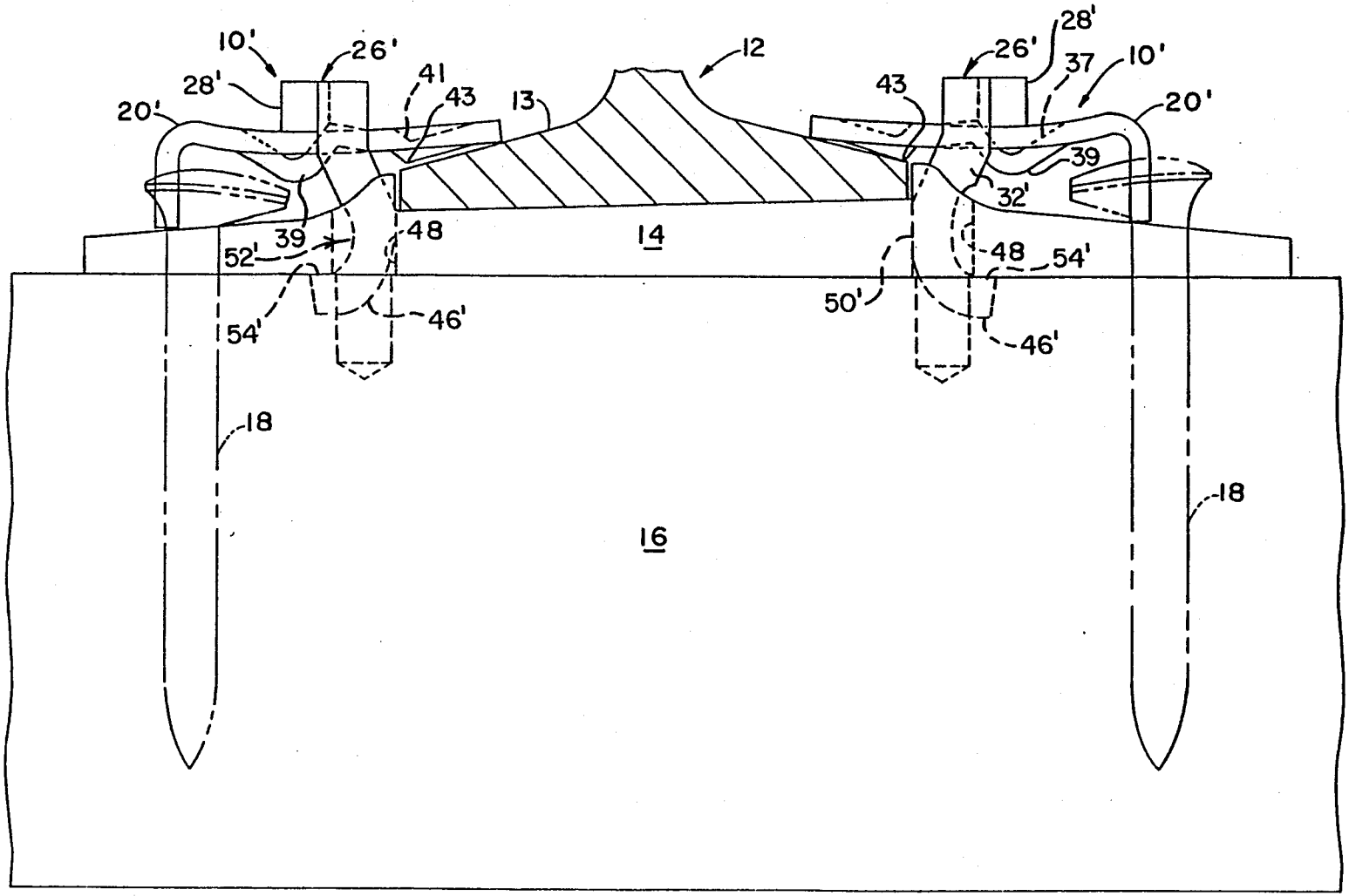
FIG. 11 is a front elevational view of a rail fastening assembly shown in FIG. 10.
Figure 12:
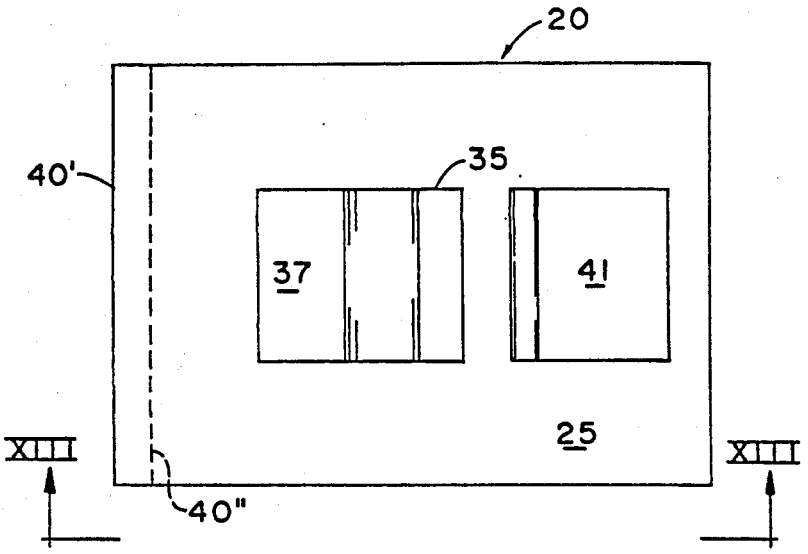
FIG. 12 is a plan view of one of the rail clips employed in the rail fastening assemblies of FIG. 10.
Figure 13:
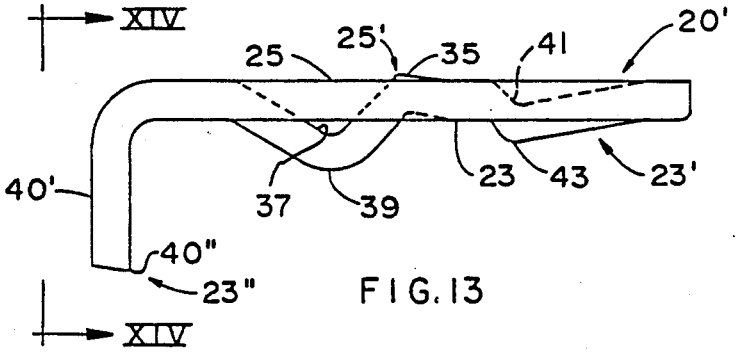
FIG. 13 is a front elevational view of the clip depicted in FIG. 12.
Figure 14:
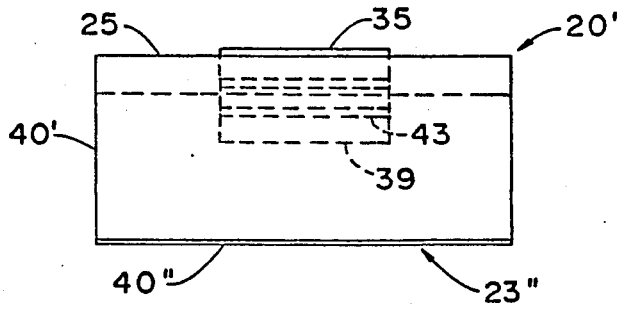
FIG. 14 is a left side elevational view of the clip of FIG. 13.
Figure 15:
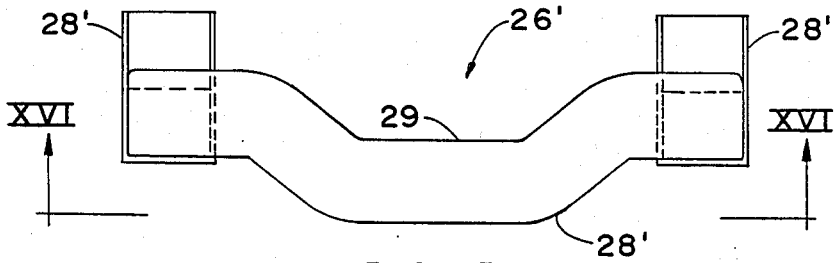
FIG. 15 is a plan view of one of the retaining shoulders used in the assemblies of FIG. 10.
Figure 16:
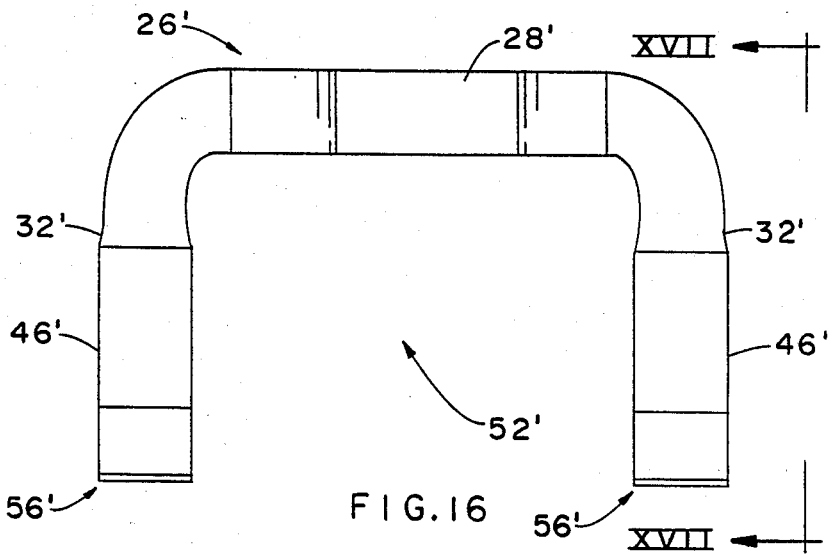
FIG. 16 is a front elevational view of the rail fastening shoulder depicted in FIG. 15.
Figure 17:
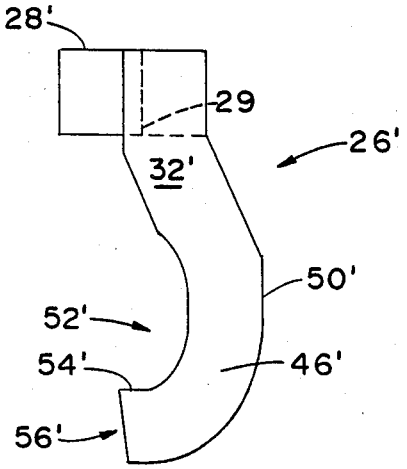
FIG. 17 is a right side elevational view of the shoulder of FIG. 16.

Turning to FIGS. 10 through 17, there is shown an alternate embodiment of the invention. FIGS. 10 and 11 illustrate a pair of installed railway rail fastening assemblies 10' much like that depicted in FIGS. 1 and 2. Assembly 10' includes a resilient, drive-on, platelike, metal, spring clip 20', having a first bearing surface 23 and a second bearing surface 25, and a restraining shoulder 26' including head portion 28', having a clip engaging surface 29, and a base portion 32'. First clip bearing surface 23 includes a rail bearing end and a tie plate bearing end designated generally at locations 23' and 23'', respectively. Second clip bearing surface 25 includes a shoulder bearing portion designated generally at location 25'.

Clip 20', on second bearing surface 25, includes an upwardly projecting portion 35. Shoulder head portion 28' includes a clip engaging surface 29 for receiving upraised portion 35 of clip 20' in latching, abuting engagement when shoulder 26' and clip 20' are operatively assembled. Clip 20' may additionally include a first recess 37 disposed therein and projecting downwardly to a lowermost point 39 and then upwardly to raised portion 35. It is at location 39 that clip 20' can be forced upwardly to assist in clip removal from its operative position. Clip 20' may also include a second recess 41 disposed therein and projecting downwardly to provide a ramp surface 43 for guiding the clip along the sloping surface of a railway rail base during clip installation. At the tie plate engaging end, clip 20' might include a downturned distal end 40' to provide a surface for driving the clip into its operative position. Also, at the tie plate bearing end, clip 20' might terminate at an edge 40'' defining a line which may engage a groove (not shown) disposed on the upper surface of the tie plate and directed generally parallel to the railway rail to provide resistance to movement of the installed clip in a direction transverse to the rail.

Shoulder base portion 32' includes downwardly depending legs 46' having a generally flat tie plate aperture bearing surface 50', a jaw portion 52', a tie plate engaging portion 54', and a terminating hook-like portion generally designated as 56'. Shoulder 26' is positioned for use with clip 20' in generally the same manner as heretofore indicated in conjunction with the operation of shoulder 26 and clip 20.

While in accordance with provisions of the statutes there is described herein a specific embodiment of the invention, those skilled in the art will understand that changes may be made in the form of the invention covered by the claims appended hereto without departing from the scope and spirit thereof, and that certain features of the invention may sometimes be used to an advantage without corresponding use of the other features.

The embodiments of the invention in which an exclusive property or privilege is claimed are defined as follows:

1. A boltless two piece rail fastening assembly for securing a base of a railway rail onto a tie plate when attached to a wooden cross tie, said tie plate having means for locating the rail base thereon and having at least two spike apertures therethrough proximate said locating means, said fastening assembly comprising:

a resilient drive-on, platelike, spring clip having first and second bearing surfaces including a rail bearing portion, a tie plate bearing portion and a shoulder bearing portion, said rail and tie plate bearing portions being located on said first bearing surface proximate distal ends thereof, said shoulder bearing portion being located on said second bearing surface intermediate distal ends thereof; and a shoulder including a head portion and a base portion, said head portion having a generally flat, clip-engaging, bottom surface and said base portion having a pair of anchor members extending from said head portion and defining distal hookshaped ends adapted for placement in said tie plate spike apertures so as to engage said tie plate when affixed to said wooden cross tie to locate said head portion proximate the rail base;

said shoulder and clip being mutually cooperable to effect interlocking therebetween and cause said clip to exert a downward force against the rail base.

2. The assembly according to claim 1 wherein said shoulder and clip are made from a metallic material having a Rockwell hardness on the C scale of between approximately 40 to approximately 44.

3. The assembly according to claim 1 wherein each of said anchor members includes first and second faces, said first face having a generally flat tie plate aperture bearing surface and said second face being opposite said first face and defining said hook-shaped ends for engaging said tie plate adjacent the corresponding aperture.

4. The assembly according to claim 3 wherein said hook-shaped ends are adapted to engage the bottom surface of said tie plate so as to prevent withdrawal of said shoulder from said tie plate.

5. The assembly according to claim 3 wherein said jaw means defines an opening facing in a direction away from said railway rail.

6. The assembly according to claim 3 wherein said jaw means defines an opening facing toward said railway rail.

7. The assembly according to claim 1 including means disposed on said shoulder and means disposed on said clip cooperating to provide latching means for interlocking said shoulder and said clip.

8. The assembly according to claim 7 wherein said latching means comprises a first protuberance on said clip second bearing surface and a recess formed in said bottom surface of said shoulder head portion adapted to receive said first protuberance therein, said first protuberance defining a detent coacting with said shoulder to prevent release of said clip when said clip and shoulder are operatively engaged.

9. The assembly according to claim 8 wherein said clip includes means facilitating driving of said clip into operative engagement with said shoulder.

10. The assembly according to claim 9 wherein said means comprises an upturned distal end on said clip at said tie plate bearing portion.

11. The assembly according to claim 9 wherein said means comprises a downturned distal end formed on said clip at said tie plate bearing portion.

12. The assembly according to claim 9 wherein said rail base has a sloping surface proximate said tie plate locating means when supported on said tie plate, said clip having an upwardly sloped ramp at said rail bearing portion providing means for guiding said clip along the slopping surface of said railway rail during clip installation.

13. The assembly according to claim 12 wherein said clip further includes stop means disposed on said clip second bearing surface.

14. The assembly according to claim 13 wherein said stop means comprises a second protuberance on said clip adapted to abut said head portion of said shoulder to prevent said clip from being driven beyond a predetermined operative position.

15. A boltless two piece rail fastening assembly for securing a base of a railway rail onto a tie plate when attached to a wooden cross tie, said tie plate having means for locating the rail base thereon and having at lease two spike holes therethrough proximate said locating means, said fastening assembly comprising:

a resilient, drive-on, platelike, spring clip having first and second bearing surfaces, said first bearing surface including a rail bearing portion and a tie plate bearing portion located proximate opposite distal ends of said first bearing surface, said second bearing surface including a shoulder bearing portion located intermediate distal ends of said second bearing surface; and a restraining shoulder comprising a head portion and a base portion, said base portion including at least two downwardly projecting substantially parallel anchor legs having hook-shaped distal ends configured to pass through said spike holes in said tie plate when affixed to said wooden cross tie so as to releasably anchor said shoulder to said tie plate proximate the base flange of said rail, said head portion and said clip being mutually cooperable to cause said clip to exert a restraining force against the rail base and effect self-tightening therebetween to prevent unintentional release of said clip from said rail base.

16. The assembly according to claim 15 wherein said hook-shaped distal ends on said anchor legs are adapted for engagement with the bottom surface of said tie plate when inserted through said spike holes to secure said shoulder to said tie plate.

17. The assembly according to claim 15 wherein said clip includes a downturned segment at said tie plate bearing end.

18. The assembly according to claim 15 wherein said clip includes a first recess disposed generally centrally in said clip second bearing surface and defined by a projection extending below said first bearing surface so as to facilitate removal of said clip from said shoulder after installation.

19. The assembly according to claim 18 wherein said clip includes a second recess disposed in said clip second bearing surface proximate the rail bearing end of said clip and defined by a projection extending below said first bearing surface so as to provide a ramp surface for guiding said clip along a sloping surface of said railway rail base during clip installation.

20. The assembly according to claim 19 wherein said clip second bearing surface includes an upraised section on said second bearing surface at a location between said first and second recesses providing latching engagement between said clip and said shoulder head portion when said clip and said shoulder are operatively engaged.

21. A resilient spring clip adapted to be driven in cooperative engagement with an associated retaining shoulder for securing a railway rail to a support therefor, said shoulder defining a generally flat clip engaging surface disposed substantially parallel to said rail support, said clip engaging surface having a recess formed thereon, said clip comprising a platelike body having first and second bearing surfaces including a rail bearing portion, a tie plate bearing portion and a shoulder bearing portion, said rail and tie plate bearing portions being located on said first bearing surface proximate distal ends of said first bearing surface, said shoulder bearing portion being located on said second bearing surface intermediate distal ends of said second bearing surface, first boss means formed on said shoulder bearing portion for cooperation with the recess in said shoulder for latching said shoulder and clip in interlocking relation when said shoulder and clip are operatively engaged, and second boss means formed on said shoulder bearing portion so as to abut said shoulder when said shoulder and clip are operatively engaged, said second boss means preventing said clip from being driven beyond a predetermined operative position relative to said retaining shoulder.

22. A resilient spring clip as defined in claim 21 wherein said clip includes an upturned distal end at said tie plate bearing portion facilitating driving of said clip into operative engagement with said shoulder.

23. The clip as defined in claim 21 wherein said clip includes a downturned distal end at said tie bearing portion facilitating driving of said clip into operative engagement with said should.

24. The clip as defined in claim 21 wherein said clip includes a first recess disposed generally centrally in said second bearing surface defined by a projection extending in elevation below said first bearing surface.

25. The clip according to claim 24 wherein said clip includes a second recess disposed in said clip second bearing surface proximate the rail bearing end of said clip and projecting in elevation below said first bearing surface at said second recess location providing a ramp means for guiding said clip along the sloping surface of said railway rail base during clip installation.

26. The clip according to claim 25 wherein said clip second bearing surface includes an upraised section on said second bearing surface at a location between said first and second recesses providing latching engagement between said shoulder and said clip when said clip and said shoulder are operatively engaged.

27. A retaining shoulder for assembly with an associated platelike spring clip for securing a railway rail onto a tie plate when affixed to a wooden cross tie, said tie plate having means for locating the base flange of a railway rail thereon and having at least two spike apertures therethrough proximate said locating means, said shoulder comprising a body including a head portion having a clip engaging surface and a base portion having a pair of anchor legs extending from said head portion and defining hook-shaped distal ends adapted for placement through said two spike apertures so as to enable outward tilting of said clip relative to said tie plate rail locating means, said shoulder being adapted to receive said clip beneath said clip engaging surface and including means for interlocking said shoulder and said clip when in assembled relation.

28. The shoulder according to claim 27 wherein said last named means includes a recess formed in said clip engaging surface for receiving a detent on said clip when said shoulder and said clip are operatively engaged.

29. The shoulder according to claim 27 wherein said clip engaging surface is an downwardly projecting face adapted to receive in latching engagement an upraised portion of an associated clip when said shoulder and said clip are operatively engaged.

30. The shoulder according to claim 27 wherein said anchor legs include a first generally flat tie plate aperture bearing face and a second face opposite said first face comprising jaw means for engaging a portion of said tie plate.

31. The shoulder according to claim 30 wherein said jaw means define said hook-shaped ends for projection beneath and engagement with the bottom surface of said tie plate to secure said shoulder to said tie plate.

* * * * *